US009431138B2

(12) United States Patent
Allen et al.

(10) Patent No.: US 9,431,138 B2
(45) Date of Patent: Aug. 30, 2016

(54) METHOD OF GENERATING SPECIFIED ACTIVITIES WITHIN A TARGET HOLDING DEVICE

(75) Inventors: Melissa Allen, Wilmington, NC (US); William Earl Russell, II, Wilmington, NC (US)

(73) Assignee: GE-Hitachi Nuclear Energy Americas, LLC, Wilmington, NC (US)

( * ) Notice: Subject to any disclaimer, the term of this patent is extended or adjusted under 35 U.S.C. 154(b) by 2421 days.

(21) Appl. No.: 12/458,399

(22) Filed: Jul. 10, 2009

(65) Prior Publication Data

US 2011/0009686 A1 Jan. 13, 2011

(51) Int. Cl.
*G21G 1/02* (2006.01)

(52) U.S. Cl.
CPC ..... *G21G 1/02* (2013.01)

(58) Field of Classification Search
USPC ..... 376/202
See application file for complete search history.

(56) References Cited

U.S. PATENT DOCUMENTS

| | | | | |
|---|---|---|---|---|
| 2,170,535 | A | 8/1939 | Marsden | |
| 2,879,216 | A * | 3/1959 | Hurwitz, Jr. et al. | 376/287 |
| 3,594,275 | A | 7/1971 | Ransohoff et al. | |
| 3,649,036 | A | 3/1972 | Harz | |
| 3,940,318 | A | 2/1976 | Arino et al. | |
| 3,955,093 | A * | 5/1976 | Quinby | 250/493.1 |
| 3,998,691 | A | 12/1976 | Shikata et al. | |
| 4,196,047 | A | 4/1980 | Mitchem et al. | |
| 4,284,472 | A | 8/1981 | Pomares et al. | |
| 4,364,898 | A * | 12/1982 | Meyer et al. | 376/190 |
| 4,462,956 | A | 7/1984 | Boiron et al. | |
| 4,475,948 | A | 10/1984 | Cawley et al. | |
| 4,493,813 | A | 1/1985 | Loriot et al. | |
| 4,532,102 | A | 7/1985 | Cawley | |
| 4,597,936 | A | 7/1986 | Kaae | |
| 4,617,985 | A | 10/1986 | Triggs et al. | |
| 4,663,111 | A | 5/1987 | Kim et al. | |
| 4,729,903 | A | 3/1988 | McGovern et al. | |
| 4,782,231 | A | 11/1988 | Svoboda et al. | |

(Continued)

FOREIGN PATENT DOCUMENTS

| | | | |
|---|---|---|---|
| CN | 2788832 | Y | 6/2006 |
| JP | 2006-162612 | A | 6/2006 |

(Continued)

OTHER PUBLICATIONS

Search Report issued in connection with EP Patent Application No. 10168515.4, May 3, 2012.

(Continued)

*Primary Examiner* — Sean P Burke
(74) *Attorney, Agent, or Firm* — Harness, Dickey & Pierce, P.L.C.

(57) ABSTRACT

A method for producing uniform activity targets according to an embodiment of the invention may include arranging a plurality of targets in a holding device having an array of compartments, each target being assigned to a compartment based on a known flux of a reactor core so as to facilitate an appropriate exposure of the targets to the flux based on target placement within the array of compartments. The holding device may be positioned within the reactor core to irradiate the targets. The method may be used to produce brachytherapy and/or radiography targets (e.g., seeds, wafers) in a reactor core such that the targets have relatively uniform activity.

20 Claims, 8 Drawing Sheets

(56) References Cited

U.S. PATENT DOCUMENTS

| | | | | |
|---|---|---|---|---|
| 4,859,431 | A | 8/1989 | Ehrhardt | |
| 5,053,186 | A | 10/1991 | Vanderheyden et al. | |
| 5,145,636 | A | 9/1992 | Vanderhevden et al. | |
| 5,355,394 | A | 10/1994 | Van Geel et al. | |
| 5,400,375 | A | 3/1995 | Suzuki et al. | |
| 5,513,226 | A | 4/1996 | Baxter et al. | |
| 5,596,611 | A | 1/1997 | Ball | |
| 5,615,238 | A | 3/1997 | Wiencek et al. | |
| 5,633,900 | A | 5/1997 | Hassal | |
| 5,682,409 | A | 10/1997 | Caine | |
| 5,707,053 | A | 1/1998 | Plunkett et al. | |
| 5,758,254 | A | 5/1998 | Kawamura et al. | |
| 5,829,739 | A | 11/1998 | Hofmann | |
| 5,867,546 | A | 2/1999 | Hassal | |
| 5,871,708 | A | 2/1999 | Park et al. | |
| 5,910,971 | A | 6/1999 | Ponomarev-Stepnoy et al. | |
| 6,056,929 | A | 5/2000 | Hassal | |
| 6,160,862 | A | 12/2000 | Wiencek et al. | |
| 6,192,095 | B1 | 2/2001 | Sekine et al. | |
| 6,233,299 | B1 * | 5/2001 | Wakabayashi | 376/202 |
| 6,456,680 | B1 | 9/2002 | Abalin et al. | |
| 6,678,344 | B2 | 1/2004 | O'Leary et al. | |
| 6,751,280 | B2 | 6/2004 | Mirzadeh et al. | |
| 6,804,319 | B1 | 10/2004 | Mirzadeh et al. | |
| 6,895,064 | B2 | 5/2005 | Ritter | |
| 6,896,716 | B1 | 5/2005 | Jones, Jr. | |
| 7,017,253 | B1 | 3/2006 | Riggle | |
| 7,157,061 | B2 | 1/2007 | Meikrantz et al. | |
| 7,235,216 | B2 | 6/2007 | Kiselev et al. | |
| 7,641,156 | B2 | 1/2010 | Medders et al. | |
| 7,798,479 | B1 | 9/2010 | Meeks et al. | |
| 7,934,710 | B2 | 5/2011 | Chiu | |
| 8,050,377 | B2 | 11/2011 | Russell, II et al. | |
| 2002/0034275 | A1 | 3/2002 | Abalin et al. | |
| 2002/0114420 | A1 | 8/2002 | O'Leary et al. | |
| 2003/0012325 | A1 | 1/2003 | Kernert et al. | |
| 2003/0016775 | A1 | 1/2003 | Jamriska, Sr. et al. | |
| 2003/0103896 | A1 | 6/2003 | Smith | |
| 2003/0179844 | A1 | 9/2003 | Filippone | |
| 2003/0227991 | A1 * | 12/2003 | Kang et al. | 376/202 |
| 2004/0091421 | A1 | 5/2004 | Aston et al. | |
| 2004/0105520 | A1 | 6/2004 | Carter | |
| 2004/0196942 | A1 | 10/2004 | Mirzadeh et al. | |
| 2004/0196943 | A1 | 10/2004 | Di Caprio | |
| 2005/0105666 | A1 | 5/2005 | Mirzadeh et al. | |
| 2005/0118098 | A1 | 6/2005 | Vincent et al. | |
| 2006/0062342 | A1 | 3/2006 | Gonzalez Lepera et al. | |
| 2006/0126774 | A1 | 6/2006 | Kim et al. | |
| 2007/0133731 | A1 * | 6/2007 | Fawcett et al. | 376/202 |
| 2007/0133734 | A1 | 6/2007 | Fawcett et al. | |
| 2007/0297554 | A1 | 12/2007 | Lavie et al. | |
| 2008/0031811 | A1 | 2/2008 | Ryu et al. | |
| 2008/0076957 | A1 | 3/2008 | Adelman | |
| 2009/0135983 | A1 | 5/2009 | Russell, II et al. | |
| 2009/0135990 | A1 | 5/2009 | Poon et al. | |

FOREIGN PATENT DOCUMENTS

| | | | |
|---|---|---|---|
| JP | 2009-133854 | A | 6/2009 |
| JP | 2009-271064 | A | 11/2009 |
| TW | 436814 | B | 5/2001 |
| TW | 516952 | B | 1/2003 |

OTHER PUBLICATIONS

Japanese Office Action dated Jul. 15, 2014, issued in Japanese Application No. 2010-156346.

Taiwan office action issued in corresponding TW Application No. 099122757, issued Sep. 23, 2014.

* cited by examiner

METHOD OF GENERATING SPECIFIED ACTIVITIES WITHIN A TARGET HOLDING DEVICE

BACKGROUND

1. Field

The present application relates to methods for the production of brachytherapy and radiography targets.

2. Description of Related Art

Conventional methods for producing brachytherapy seeds involve non-irradiated wires (e.g., non-irradiated iridium wires) that are subsequently provided with the desired activity. The desired activity may be provided thereto through neutron absorption in a nuclear reactor.

Brachytherapy seeds have also been produced from irradiated wires. With regard to the production of the seeds, the irradiation of long wires has been suggested, wherein the irradiated wires are subsequently cut into individual seeds. However, because of flux variations in a reactor, the attainment of seeds with uniform activity is difficult.

SUMMARY

A method for producing uniform activity targets according to an embodiment of the invention may include arranging a plurality of targets in a holding device having an array of compartments. Each target is assigned to a compartment based on a known flux of a reactor core so as to facilitate an appropriate exposure of the targets to the flux based on target placement within the array of compartments. The holding device is positioned within the reactor core to irradiate the targets. The targets may be formed of the same or different materials and may be placed individually or in groups in the compartments.

The targets may be radially arranged such that more targets are grouped together in compartments that are at a greater radial distance from a center of the holding device. The targets may also be axially arranged such that more targets are grouped together in compartments in axial portions of the holding device that are subjected to higher flux during irradiation. Furthermore, more targets may be grouped together in compartments that are in closer proximity to the flux during irradiation.

The targets may also be arranged based on their self-shielding properties. For instance, targets with lower self-shielding properties may be grouped together in one or more compartments, while targets with higher self-shielding properties may be separated from each other so as to be grouped in different compartments.

The targets may also be arranged based on their different cross sections. For instance, targets having lower cross sections may be arranged in one or more compartments that are in closer proximity to the flux during irradiation. The number of targets in a compartment may be increased so as to decrease a resulting activity of each target in the compartment after irradiation. The method for producing uniform activity targets may further include waiting a predetermined period of time for impurities to decay after irradiation prior to collecting the irradiated targets.

A method for producing uniform activity targets according to another embodiment of the invention may include positioning targets within a holding device according to a predetermined or subsequently determined target loading configuration. The determined target loading configuration is based on a required flux for each target in conjunction with a known environment of a reactor core that is used to irradiate the targets. The determined target loading configuration may be in a form of a ring pattern and/or correspond to a shape of a target plate of the holding device. As a result of the determined target loading configuration, a target may be subjected to uniform or non-uniform flux.

A method for producing uniform activity targets according to another embodiment of the invention may include arranging a plurality of targets in a holding device having an array of compartments, each target being assigned to a compartment based on a known flux of a reactor core so as to facilitate an appropriate exposure of the targets to the flux based on target placement within the array of compartments. The holding device is positioned within the reactor core to irradiate the targets. The targets may be formed of different natural or enriched neutron-absorption isotopes and may be arranged by isotope type, cross section, and self-shielding properties.

BRIEF DESCRIPTION OF THE DRAWINGS

The various features and advantages of the non-limiting embodiments herein may become more apparent upon review of the detailed description in conjunction with the accompanying drawings. The accompanying drawings are merely provided for illustrative purposes and should not be interpreted to limit the scope of the claims. The accompanying drawings are not to be considered as drawn to scale unless explicitly noted. For purposes of clarity, various dimensions of the drawings may have been exaggerated.

DETAILED DESCRIPTION

Figure 1:
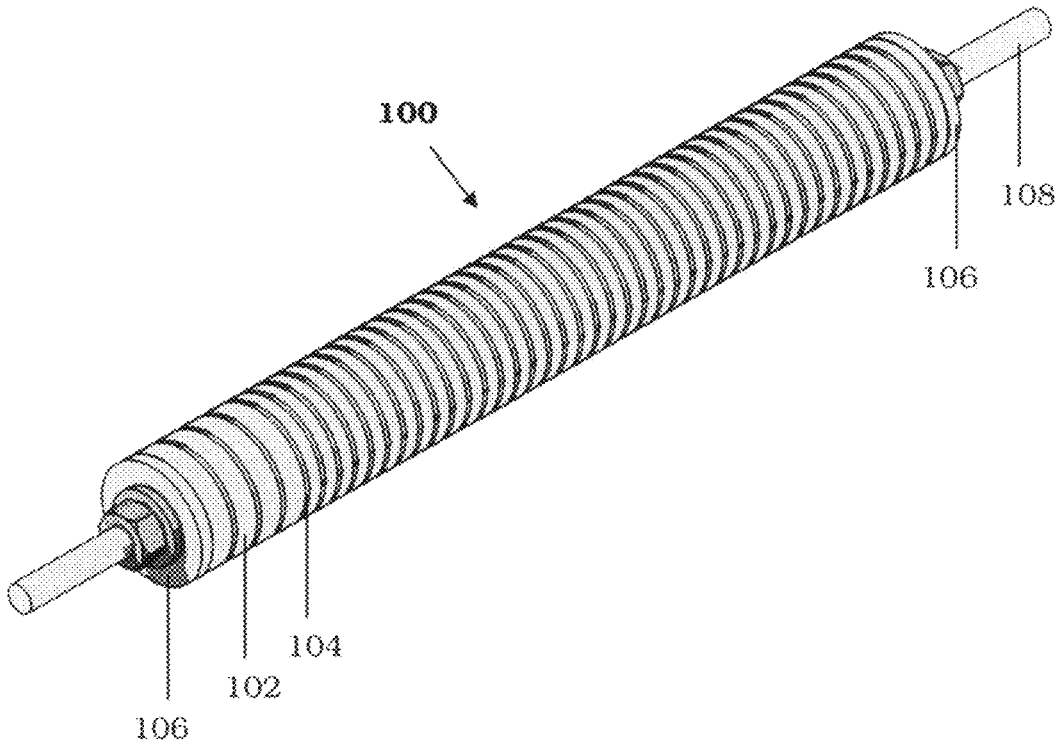
FIG. 1 is a perspective view of a target holding device according to an embodiment of the invention.

It should be understood that when an element or layer is referred to as being "on," "connected to," "coupled to," or "covering" another element or layer, it may be directly on, connected to, coupled to, or covering the other element or layer or intervening elements or layers may be present. In contrast, when an element is referred to as being "directly on," "directly connected to," or "directly coupled to" another element or layer, there are no intervening elements or layers present. Like numbers refer to like elements throughout the specification. As used herein, the term "and/or" includes any and all combinations of one or more of the associated listed items.

It should be understood that, although the terms first, second, third, etc. may be used herein to describe various elements, components, regions, layers and/or sections, these elements, components, regions, layers, and/or sections should not be limited by these terms. These terms are only used to distinguish one element, component, region, layer, or section from another region, layer, or section. Thus, a first element, component, region, layer, or section discussed below could be termed a second element, component, region, layer, or section without departing from the teachings of example embodiments.

Spatially relative terms (e.g., "beneath," "below," "lower," "above," "upper," and the like) may be used herein for ease of description to describe one element or feature's relationship to another element(s) or feature(s) as illustrated in the figures. It should be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" may encompass both an orientation of above and below. The device may be otherwise oriented (rotated 90 degrees or at other orientations) and the spatially relative descriptors used herein interpreted accordingly.

The terminology used herein is for the purpose of describing various embodiments only and is not intended to be limiting of example embodiments. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Example embodiments are described herein with reference to cross-sectional illustrations that are schematic illustrations of idealized embodiments (and intermediate structures) of example embodiments. As such, variations from the shapes of the illustrations as a result, for example, of manufacturing techniques and/or tolerances, are to be expected. Thus, example embodiments should not be construed as limited to the shapes of regions illustrated herein but are to include deviations in shapes that result, for example, from manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature and their shapes are not intended to illustrate the actual shape of a region of a device and are not intended to limit the scope of example embodiments.

Unless otherwise defined, all terms (including technical and scientific terms) used herein have the same meaning as commonly understood by one of ordinary skill in the art to which example embodiments belong. It will be further understood that terms, including those defined in commonly used dictionaries, should be interpreted as having a meaning that is consistent with their meaning in the context of the relevant art and will not be interpreted in an idealized or overly formal sense unless expressly so defined herein.

A method according to the present invention enables the production of brachytherapy and/or radiography targets (e.g., seeds, wafers) in a reactor core such that the targets have relatively uniform activity. The targets may be used in the treatment of cancer (e.g., breast cancer, prostate cancer). For example, during cancer treatment, multiple targets (e.g., seeds) may be placed in a tumor. As a result, targets having relatively uniform activity will provide the intended amount of radiation so as to destroy the tumor without damaging surrounding tissues. The device of producing such targets is described in further detail in "BRACHYTHERAPY AND RADIOGRAPHY TARGET HOLDING DEVICE" (HDP Ref.: 8564-000184/US; GE Ref.: 24IG237430), filed concurrently herewith, the entire contents of which are incorporated herein by reference.

Figure 2:
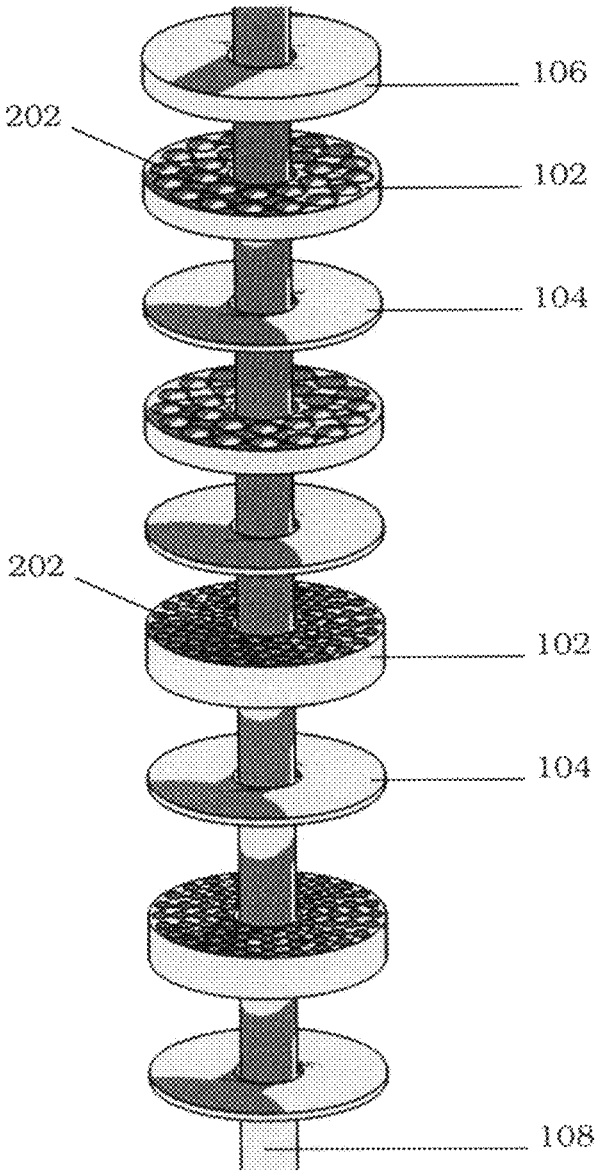
FIG. 2 is a partially exploded view of a target holding device according to an embodiment of the invention.

FIG. 1 is a perspective view of a target holding device according to an embodiment of the invention. FIG. 2 is a partially exploded view of a target holding device according to an embodiment of the invention. Referring to FIGS. 1-2, the target holding device 100 includes a plurality of target plates 102 and a plurality of separator plates 104, wherein the plurality of target plates 102 and the plurality of separator plates 104 are alternately arranged. The thickness of each of the target plates 102 may be varied as needed to accommodate for the size of the intended targets to be contained therein. Thus, although the lower target plates 102 are shown as being thicker than the upper target plates 102, the opposite may be true or the target plates 102 may all be of the same thickness. Furthermore, although the target plates 102 are shown as having the same diameter, the target plates 102 may have different diameters (e.g., tapering arrangement) based on reactor conditions and/or intended targets.

The alternately arranged target plates 102 and separator plates 104 are sandwiched between a pair of end plates 106. A shaft 108 passes through the end plates 106 and the alternately arranged target plates 102 and separator plates 104 to facilitate the alignment and joinder of the plates. The joinder of the end plates 106 and the alternately arranged target plates 102 and separator plates 104 may be secured with a nut and washer arrangement although other suitable fastening mechanisms may be used. Furthermore, although the target holding device 100 is shown as having a single shaft 108, it should be understood that a plurality of shafts 108 may be employed.

As shown in FIG. 2, each target plate 102 has a plurality of holes/compartments 202 in addition to the central hole for the shaft 108. The plurality of holes 202 may be provided in various sizes and configurations depending on production requirements. Although the upper and lower target plates 102 are shown as having holes 202 of different sizes and configurations, it should be understood that all the target plates 102 may have holes 202 of the same size and/or configuration.

The plurality of holes 202 may extend partially or completely through each target plate 102. When the holes 202 are provided such that they only extend partially through each target plate 102, the separator plates 104 may be omitted. In such a case, an upper surface of a target plate 102 would directly contact a lower surface of an adjacent target plate 102. On the other hand, when the holes 202 are provided such that they extend completely through the target plates 102, the separator plates 104 are placed between the target plates 102 so as to separate the holes 202 of each target plates 102, thereby defining a plurality of individual compartments within each target plate 102 for holding one or more targets (e.g., seeds, wafers) therein.

Figure 3:
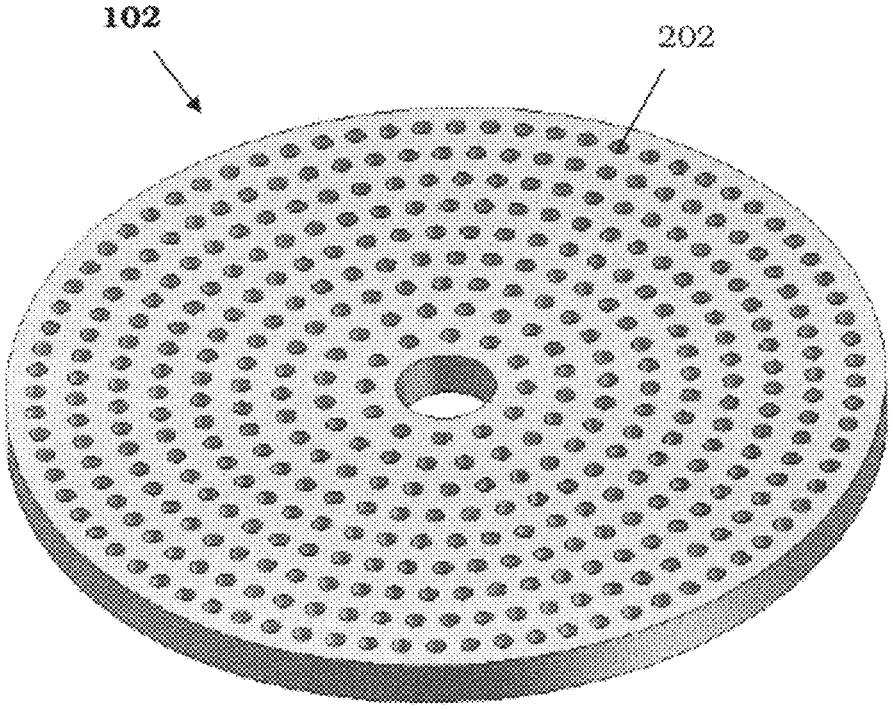
FIG. 3 is a perspective view of a target plate according to an embodiment of the invention.

FIG. 3 is a perspective view of a target plate according to an embodiment of the invention. Referring to FIG. 3, the target plate 102 has a plurality of holes 202 for holding one or more targets (e.g., seeds, wafers) therein during production. The target plate 102 may be formed of a relatively low cross-section material (e.g., aluminum, molybdenum, graphite, zirconium) to allow a higher amount of flux to reach the targets contained therein. For instance, the material may have a cross-section of about 10 barns or less. Alternatively, the target plate 102 may be formed of a neutron moderator material (e.g., beryllium, graphite). Furthermore, the use of materials of relatively high purity may confer the added benefit of lower radiation exposure to personnel as a result of less impurities being irradiated during target production.

The upper and lower surfaces of the target plate 102 may be polished so as to be relatively smooth and flat. The thickness of the target plate 102 may be varied to accommodate the targets to be contained therein. Although the target plate 102 is illustrated as being disc-shaped, it should be understood that the target plate 102 may have a triangular shape, a square shape, or other suitable shape. Additionally, it should be understood that the size and/or configuration of the holes 202 may be varied based on production requirements. Furthermore, although not shown, the target plate 102 may include one or more alignment markings on the side surface to assist with the orientation of the target plate 102 during the stacking step of assembling the target holding device 100.

Figure 4:
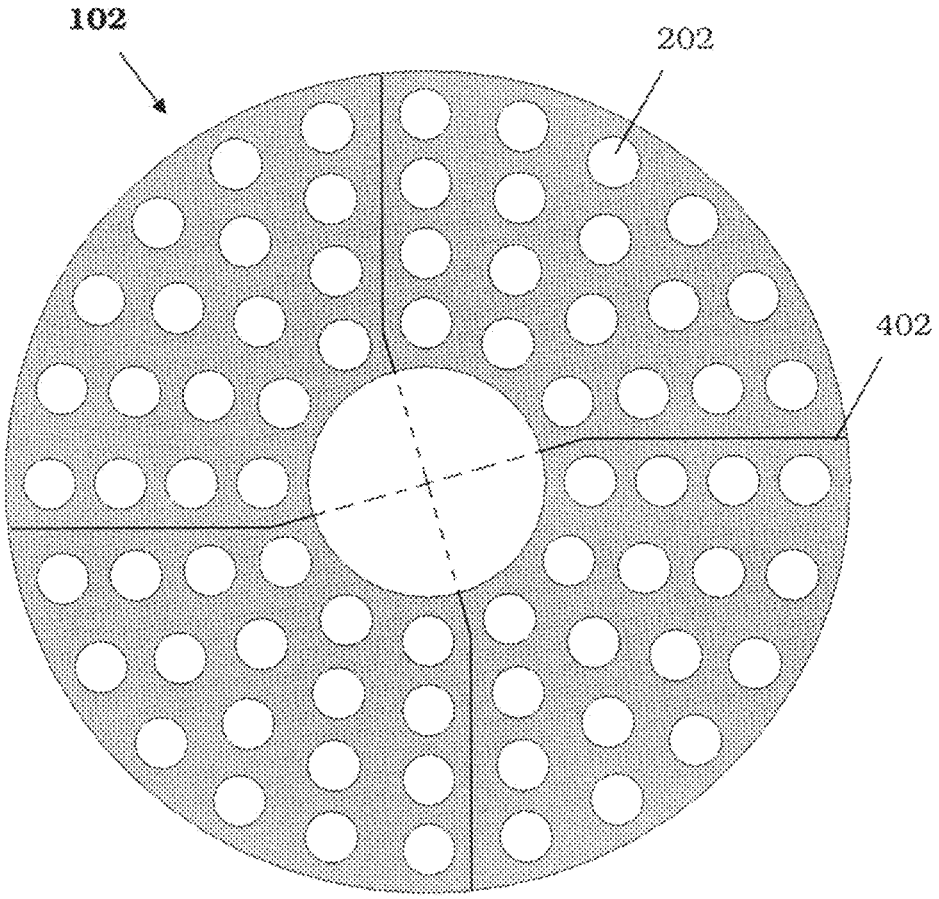
FIG. 4 is a plan view of a target plate according to an embodiment of the invention.

FIG. 4 is a plan view of a target plate according to an embodiment of the invention. Referring to FIG. 4, in addition to having a plurality of holes 202, the target plate 102 may also have sectional markings 402 to assist in the identification of each hole 202, thereby also facilitating the placement of one or more targets within the holes 202. Although the holes 202 are illustrated as extending completely through the target plate 102, it should be understood, as discussed above, that the holes may only extend partially through the target plate 102. Additionally, although the sectional markings 402 are illustrated as dividing the target plate 102 into quadrants, it should be understood that the sectional markings 402 may be alternatively provided so as to divide the target plate 102 into more or less sections. Furthermore, it should be understood that the sectional markings 402 may be linear, curved, or otherwise provided to accommodate the configuration of the holes 202 in the target plate 102.

Figure 5:
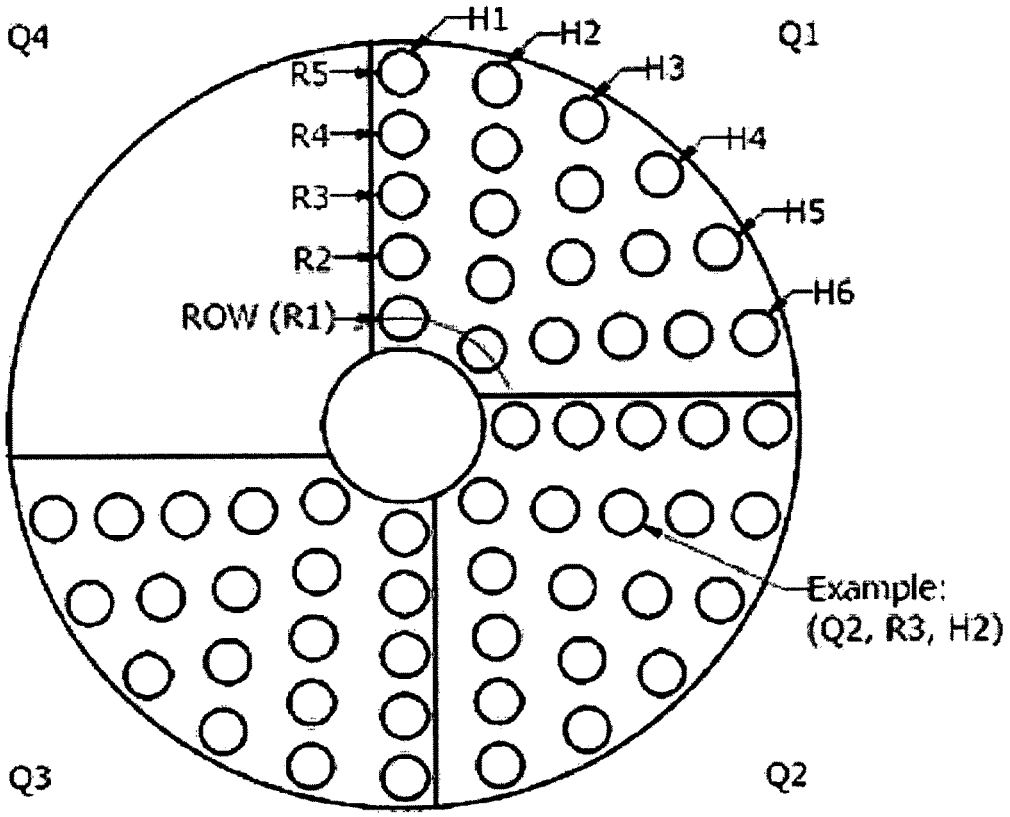
FIG. 5 is a diagram illustrating a system for mapping the holes of a target plate according to an embodiment of the invention.

FIG. 5 is a diagram illustrating a system for mapping the holes of a target plate according to an embodiment of the invention. Referring to FIG. 5, the plurality of holes in a target plate may be divided into four quadrants Q1-Q4. The plurality of holes in the target plate may also be associated with rows/rings R1-R5. The holes in each of quadrants Q1-Q4 may be further associated with holes H1-H6. With such a coordinate system based on quadrants Q1-Q4, rows R1-R5, and holes H1-H6, each hole in the target plate may be properly identified so as to facilitate the strategic placement of one or more targets therein. For instance, the hole identified as Q2, R3, H2 is expressly labeled in FIG. 5 for purposes of illustration.

It should be understood that a suitable coordinate system may differ from that shown in FIG. 5 depending on the size of the holes, the configuration of the holes, the shape of the target plate, etc. For example, an alternate coordinate system may have more or less quadrants, rows, and/or holes than as shown in FIG. 5. Furthermore, other grouping methodologies may also be suitable and need not be limited to the methodology exemplified by the quadrants, rows, and holes shown in FIG. 5.

Figure 6:
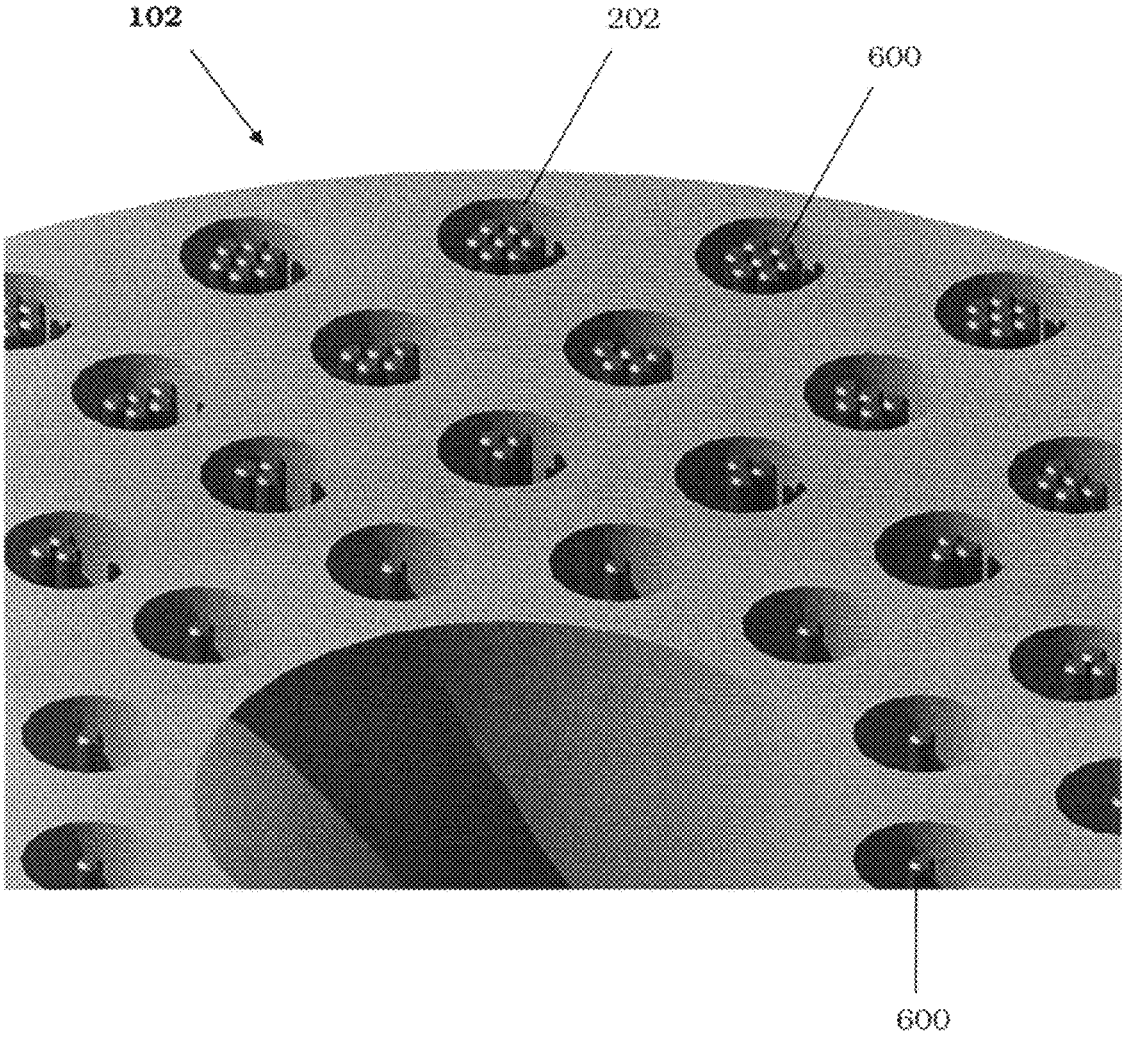
FIG. 6 is a perspective view of a target plate that has been loaded with targets according to an embodiment of the invention.

FIG. 6 is a perspective view of a target plate that has been loaded with targets according to an embodiment of the invention. Referring to FIG. 6, the holes 202 of a target plate 102 may be loaded with one or more targets 600. The targets 600 may be formed of the same material or different materials. The targets 600 may also be formed of natural isotopes or enriched isotopes. For example, suitable targets may be formed of chromium (Cr), copper (Cu), erbium (Er), germanium (Ge), gold (Au), holmium (Ho), iridium (Ir), lutetium (Lu), palladium (Pd), samarium (Sm), thulium (Tm), ytterbium (Yb), and/or yttrium (Y), although other suitable materials may also be used.

The size of the targets 600 may be adjusted as appropriate for their intended use (e.g., radiography targets). For instance, a target 600 may have a length of about 3 mm and a diameter of about 0.5 mm. It should be understood that the size of the holes 202 and/or the thickness of the target plates 102 may be adjusted as needed to accommodate the targets 600. The targets 600 are strategically loaded in the appropriate holes 202 based on various factors (including the characteristics of each target material, known flux conditions of a reactor core, the desired activity of the resulting targets, etc.) so as to attain targets 600 having relatively uniform activity.

As shown in FIG. 6, the targets may be radially arranged such that more targets are grouped together in the outer holes 202 than the inner holes 202. For instance, each of the outermost holes 202 are illustrated as containing seven targets 600, while each of the innermost holes are illustrated as containing one target 600. However, it should be understood that each hole 202 does not need to be occupied with a target 600, and the placement of a target 600 as well as the number of targets 600 in a hole 202 may vary depending on various factors, including the characteristics of the target material, known flux conditions of a reactor core, the desired activity of the resulting target, etc.

Because the outer holes 202 will be closer to the flux when the target holding device 100 is placed in a reactor core, a greater number of targets 600 may be placed in each of the outer holes 202, thereby resulting in more equal activity amongst the targets 600 in the outer holes 202. On the other hand, fewer targets 600 may be placed in each of the inner holes 202 to offset the fact that these targets 600 will be farther from the flux, thereby allowing the targets 600 in the inner holes 202 to attain activity levels comparable to the targets 600 in the outer holes 202. Thus, the number of targets 600 in each hole 202 may be increased so as to decrease the resulting activity of each target in the hole 202. Conversely, the number of targets 600 in each hole 202 may be decreased so as to increase the resulting activity of each target in the hole 202.

It should be understood that FIG. 6 assumes that all the targets 600 are formed of the same isotope to simplify the radial target placement illustration (although the targets 600 may be formed of different isotopes). Different isotopes may have different characteristics, including different neutron absorption rates and different decay rates. These characteristics will affect the overall placement as well as the grouping of the targets 600 when different isotopes are involved in the production process. For instance, if the targets 600 in the outermost holes 202 are formed of different isotopes having higher self-shielding properties than the targets 600 in the inner holes 202, then fewer such targets 600 may be needed in each of the outermost holes 202 to create the desired self-shielding effect.

In another example, iridium (Ir) and gold (Au) seeds were loaded in a target plate 102 having holes 202 corresponding to the coordinate system illustrated in FIG. 5. Iridium has a much higher neutron absorption rate, but gold has a higher decay rate and initially has higher activities. A single iridium seed was loaded in a hole 202 corresponding to Q 1, R5, H5, while two gold seeds were loaded in a hole 202 corresponding to Q 1, R4, H4. Based only on the radial placement and the number of seeds per hole, it would seem that the single iridium seed in the outermost ring would have the highest activity after irradiation. However, because of gold's high decay rate, the two gold seeds actually had the higher activities of 57.38 μCi and 58.61 μCi, respectively, compared to the 49.75 μCi for the iridium seed. Thus, characteristics of the target material (e.g., neutron absorption rate, decay rate, etc.) should be taken into account when deciding where to place and/or how to group the targets so as to attain more uniform activities.

The targets 600 may also be arranged based on cross-section, wherein cross-section (σ) is the probability that an interaction will occur and is measured in barns. For instance, targets 600 formed of materials having lower cross-sections will have a lower probability that an interaction will occur compared to targets 600 formed of materials having higher cross-sections. As a result, targets 600 formed of materials having lower cross-sections may be arranged in holes 202 that will be in closer proximity to the flux during irradiation. With regard to FIG. 6, such lower cross-section targets 600 may be placed in the outer holes 202 of the target plate 102.

Figure 7:
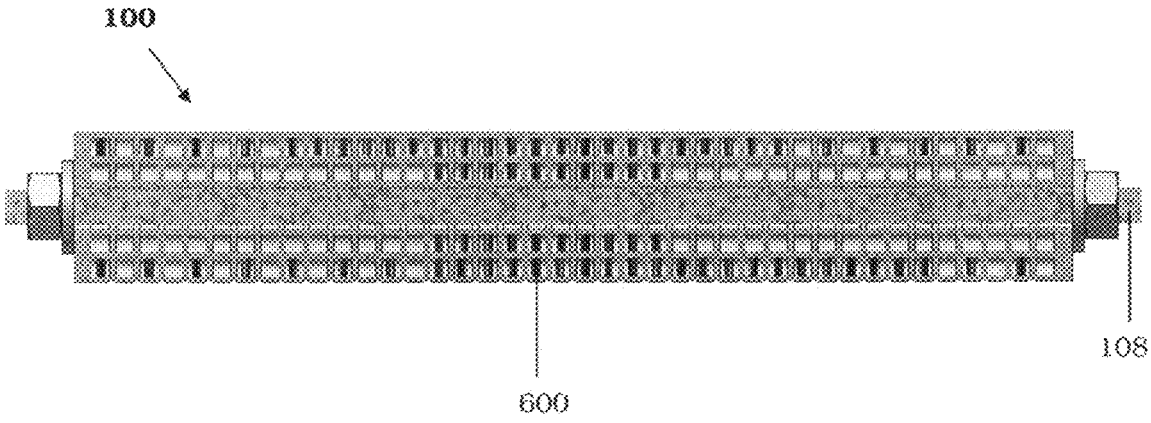
FIG. 7 is a cross-sectional view of a loaded target holding device, taken along its longitudinal axis, according to an embodiment of the invention.

FIG. 7 is a cross-sectional view of a loaded target holding device, taken along its longitudinal axis, according to an embodiment of the invention. In addition to the determination of where to place a target 600 in a target plate 102, there is also the consideration of which target plate 102 of the target holding device 100 to place the target 600. As shown in FIG. 7, the targets 600 may be axially arranged such that more targets 600 are grouped together in an axial portion of the target holding device 100 that is subjected to higher flux during irradiation in a reactor core. FIG. 7 illustrates an example where the mid-axial portion of the target holding device 100 is subjected to higher flux during irradiation in a reactor core. Furthermore, the targets 600 may be arranged so as to be more concentrated on a particular side of the target holding device 100 that will be subjected to a higher flux during irradiation.

It should be understood that when a plurality of targets 600 of different materials are to be placed in the target holding device 100 for irradiation, the individual characteristics (e.g., neutron absorption rate) of each target 600 will be considered in conjunction with external factors (e.g., known flux conditions of the reactor core) when determining the proper arrangement within the target holding device 100. For instance, not only is the proper target plate 102 and hole 202 determined for a target 600 but also whether grouping is appropriate, and if so, the target(s) 600 that should be grouped together so as to attain targets 600 in the target holding device 100 having relative uniform activity.

Figure 8:
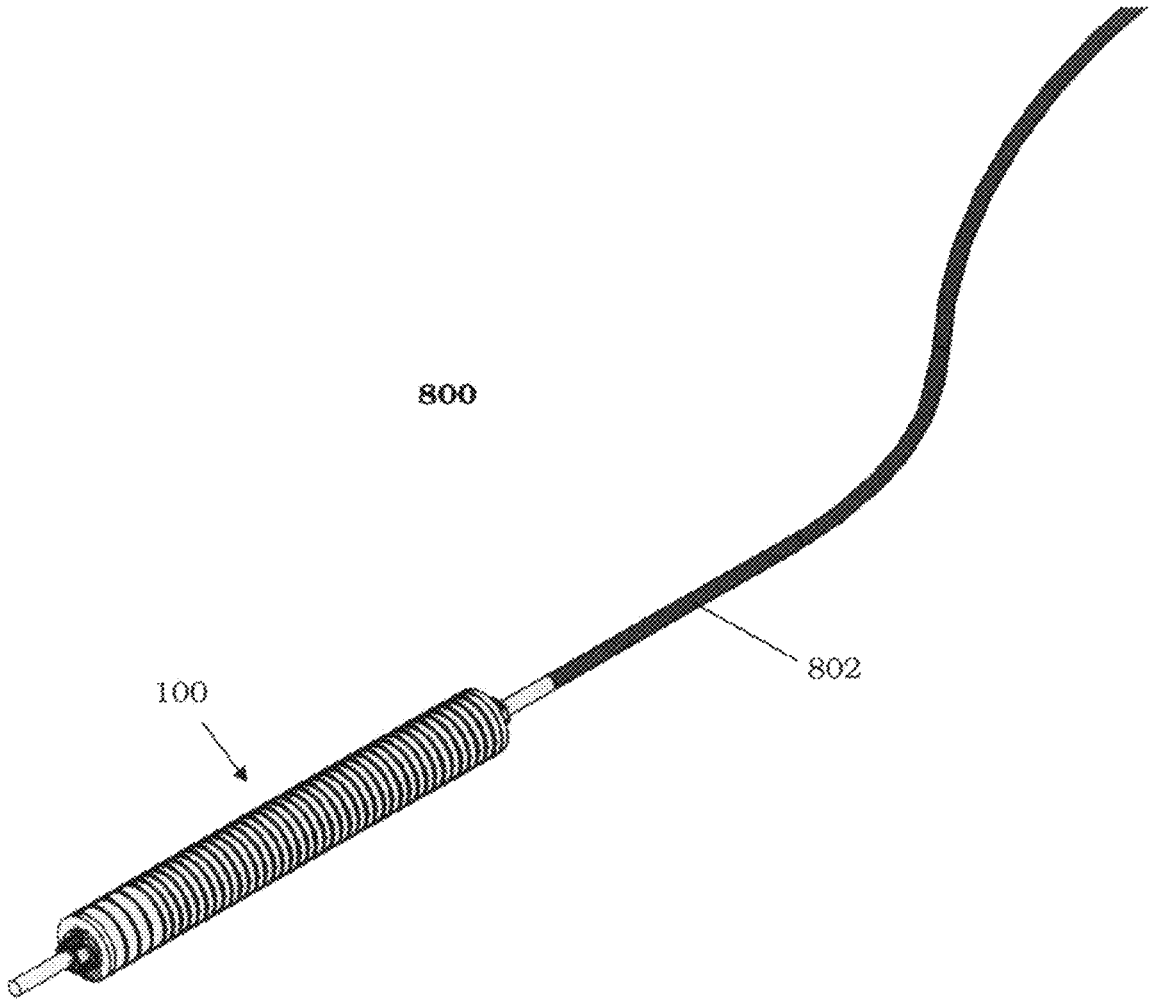
FIG. 8 is a perspective view of a target holder assembly according to an embodiment of the invention.

FIG. 8 is a perspective view of a target holder assembly according to an embodiment of the invention. Referring to FIG. 8, the target holder assembly 800 includes a target holding device 100 connected to a cable 802. The cable 802 may be formed of any material having sufficient rigidity to facilitate the introduction of the target holding device 100 into a reactor core, sufficient strength to facilitate the retrieval of the target holding device 100 from the reactor core, and sufficient flexibility to maneuver the target holding device 100 through piping turns. For instance, the cable 802 may be a braided steel cable or a flexible electrical conduit cable. To assist with the introduction of the target holding device 100 into a reactor core, the cable 802 may be marked at a predefined length, wherein the predefined length corresponds to a distance from a reference point, to a predetermined location within the reactor core.

After the target holding device 100 has been irradiated in the reactor core, a predetermined period of time may be allowed to pass before disassembling the target holding device 100 and collecting the targets 600. This waiting period may be beneficial by permitting any impurities in the target holding device 100 (as well as the targets 600 themselves) to sufficiently decay, thereby reducing or preventing the risk of harmful radiation exposure to personnel.

While a number of example embodiments have been disclosed herein, it should be understood that other variations may be possible. Such variations are not to be regarded as a departure from the spirit and scope of the present disclosure, and all such modifications as would be obvious to one skilled in the art are intended to be included within the scope of the following claims.

The invention claimed is:

1. A method for producing uniform activity targets, comprising:

arranging a plurality of targets in a holding device having an array of compartments, each target being assigned to a compartment based on a known flux of a reactor core so as to facilitate an appropriate exposure of the targets to the flux based on target placement within the array of compartments, the holding device including a plurality of target plates and a shaft extending through the plurality of target plates, the shaft structured to unite the plurality of target plates, each target plate having a first surface and an opposing second surface, the first surface having the array of compartments, the target plates arranged such that the first surface of one target plate faces the second surface of an adjacent target plate;

positioning the holding device within the reactor core to irradiate the targets; and irradiating the plurality of targets within the holding device.

2. The method of claim 1, wherein the targets are radially arranged such that more of the plurality of targets are grouped together in compartments that are at a greater radial distance from a center of the holding device relative to compartments that are at a lesser radial distance from the center of the holding device.

3. The method of claim 1, wherein the targets are axially arranged such that more of the plurality of targets are grouped together in compartments in axial portions of the holding device that are subjected to higher flux during irradiation relative to compartments in the axial portions of the holding device that are subjected to lower flux during the irradiation.

4. The method of claim 1, wherein more of the plurality of targets are grouped together in compartments that are in closer proximity to the flux during irradiation relative to compartments that are farther to the flux during the irradiation.

5. The method of claim 1, wherein targets of the same isotope are grouped together in one or more compartments.

6. The method of claim 1, wherein the plurality of targets includes different types of targets that are formed of different materials.

7. The method of claim 6, wherein the targets are arranged in the array of compartments based on their self-shielding properties.

8. The method of claim 7, wherein targets with lower self-shielding properties are grouped together in one or more compartments relative to targets with higher self-shielding properties.

9. The method of claim 7, wherein targets with higher self-shielding properties are separated from each other so as to be grouped in different compartments relative to targets with lower self-shielding properties.

10. The method of claim 6, wherein the targets are arranged in the array of compartments based on their different cross sections.

11. The method of claim 10, wherein targets having lower cross sections are arranged in one or more compartments that are in closer proximity to the flux during irradiation relative to compartments that are farther to the flux during the irradiation.

12. The method of claim 6, wherein the different types of targets are grouped together in one or more compartments.

13. The method of claim 1, wherein a number of targets in a compartment is increased so as to decrease a resulting activity of each target in the compartment after irradiation.

14. The method of claim 1, further comprising:

waiting a predetermined period of time for impurities to decay after irradiation prior to collecting the irradiated targets.

15. A method for producing uniform activity targets, comprising:

positioning targets within a holding device according to a determined target loading configuration, the determined target loading configuration being based on a required flux for each target in conjunction with a known environment of a reactor core that is used to irradiate the targets, the holding device including a plurality of target plates and a shaft extending through the plurality of target plates, the shaft structured to unite the plurality of target plates, each target plate having a first surface and an opposing second surface, the first surface having an array of compartments, the target plates arranged such that the first surface of one target plate faces the second surface of an adjacent target plate; and irradiating the targets within the holding device.

16. The method of claim 15, wherein the determined target loading configuration is in a form of a ring pattern.

17. The method of claim 15, wherein the determined target loading configuration corresponds to a shape of the target plates of the holding device.

18. The method of claim 15, wherein the determined target loading configuration results in a target being subjected to uniform flux.

19. The method of claim 15, wherein the determined target loading configuration results in a target being subjected to non-uniform flux.

20. A method for producing uniform activity targets, comprising:

arranging a plurality of targets in a holding device having an array of compartments, each target being assigned to a compartment based on a known flux of a reactor core so as to facilitate an appropriate exposure of the targets to the flux based on target placement within the array of compartments, the holding device including a plurality of target plates and a shaft extending through the plurality of target plates, the shaft structured to unite the plurality of target plates, each target plate having a first surface and an opposing second surface, the first surface having the array of compartments, the target plates arranged such that the first surface of one target plate faces the second surface of an adjacent target plate;

positioning the holding device within the reactor core to irradiate the targets, the targets being formed of different natural or enriched isotopes and arranged by isotope type, cross section, and self-shielding properties; and irradiating the plurality of targets within the holding device.

* * * * *